US010032421B2

(12) United States Patent
Yamaguchi et al.

(10) Patent No.: US 10,032,421 B2
(45) Date of Patent: Jul. 24, 2018

(54) LIQUID CRYSTAL DISPLAY DEVICE, METHOD OF DRIVING THE SAME AND DRIVE PROCESSING DEVICE

(71) Applicant: Japan Display Inc., Minato-ku (JP)

(72) Inventors: Hajime Yamaguchi, Tokyo (JP); Yasushi Kawata, Tokyo (JP); Akio Murayama, Tokyo (JP)

(73) Assignee: Japan Display Inc., Minato-ku (JP)

( * ) Notice: Subject to any disclaimer, the term of this patent is extended or adjusted under 35 U.S.C. 154(b) by 30 days.

(21) Appl. No.: 15/240,240

(22) Filed: Aug. 18, 2016

(65) Prior Publication Data

US 2017/0061910 A1 Mar. 2, 2017

(30) Foreign Application Priority Data

Aug. 28, 2015 (JP) ..... 2015-169098

(51) Int. Cl.
*G09G 3/36* (2006.01)

(52) U.S. Cl.
CPC ..... *G09G 3/3614* (2013.01); *G09G 3/3677* (2013.01); *G09G 2310/08* (2013.01); *G09G 2320/0252* (2013.01); *G09G 2320/0261* (2013.01); *G09G 2320/0271* (2013.01); *G09G 2320/041* (2013.01); *G09G 2330/021* (2013.01)

(58) Field of Classification Search
CPC ..... G09G 3/36; G09G 3/3614; G09G 3/3677; G09G 2320/0271; G09G 2310/08; G09G 2320/0252; G09G 2320/0261; G09G 2320/041; G09G 2330/021
See application file for complete search history.

(56) References Cited

U.S. PATENT DOCUMENTS

2001/0038372 A1 11/2001 Lee
2002/0044126 A1* 4/2002 Aoki ..... G09G 3/2011 345/96
2005/0088398 A1 4/2005 Lee
2006/0274007 A1 12/2006 Lee
2008/0191986 A1 8/2008 Lee
2010/0103158 A1 4/2010 Lee
2011/0298774 A1* 12/2011 Yamada ..... G09G 3/3614 345/211

FOREIGN PATENT DOCUMENTS

JP 2001-265298 9/2001

* cited by examiner

*Primary Examiner* — Md Saiful A Siddiqui
(74) *Attorney, Agent, or Firm* — Oblon, McClelland, Maier & Neustadt, L.L.P.

(57) ABSTRACT

According to one embodiment, a liquid display device includes a liquid crystal display panel provided with pixel which includes pixel electrode, and has gradation values that vary, a driver which drives the pixel electrode, and a processor which supplies, if the gradation value of the pixel varies, the driver with a correction image signal based on an addition image signal in which a voltage based on the gradation value and a compensation voltage are added. The compensation voltage is based on pixel capacitances prior to and subsequent to variation of the gradation value and a voltage subsequent to the variation of the gradation value.

19 Claims, 10 Drawing Sheets

LIQUID CRYSTAL DISPLAY DEVICE, METHOD OF DRIVING THE SAME AND DRIVE PROCESSING DEVICE

CROSS-REFERENCE TO RELATED APPLICATIONS

This application is based upon and claims the benefit of priority from Japanese Patent Application No. 2015-169098, filed Aug. 28, 2015, the entire contents of which are incorporated herein by reference.

FIELD

Embodiments described herein relate generally to a liquid crystal display device, a method of driving the same, and a drive processing device.

BACKGROUND

In general, a liquid crystal display device includes an array substrate, a counter-substrate, a liquid crystal layer held between the array substrate and the counter-substrate, and a color filter formed in one of these substrates. The gap between the substrates is held constant by spacers. As a display mode, various modes such as a twisted nematic (TN) mode are used. Each of pixels includes a thin-film transistor (TFT).

In many cases, the liquid crystal display device is driven at a frame rate of 60 Hz. If the frame rate is reduced, the power consumption can also be reduced. However, in a response of several frames, if the frame rate is reduced, it causes persistence of vision because of dielectric anisotropy of a liquid crystal.

DETAILED DESCRIPTION

In general, according to one embodiment, there is provided a liquid display device comprising: a liquid crystal display panel provided with pixel which includes pixel electrode, and has gradation values that vary; a driver which drives the pixel electrode; and a processor which supplies, if the gradation value of the pixel varies, the driver with a correction image signal based on an addition image signal in which a voltage based on the gradation value and a compensation voltage are added, wherein the compensation voltage is based on pixel capacitances prior to and subsequent to variation of the gradation value and a voltage subsequent to the variation of the gradation value.

According to another embodiment, there is provided a method of driving a liquid display device comprising: producing, in a case where a gradation value of a pixel in a liquid crystal display panel varies, a correction image signal based on an addition image signal in which a voltage based on the gradation value and a compensation voltage are added; and writing the correction image signal to a pixel electrode of the pixel, wherein the compensation voltage is based on pixel capacitances prior to and subsequent to variation of the gradation value and a voltage subsequent to the variation of the gradation value.

According to another embodiment, there is provided a drive processing device comprising: a processor, in a case where a gradation value of a pixel in a liquid crystal display panel varies, which produces a correction image signal based on an addition image signal in which a voltage based on the gradation value and a compensation voltage are added; and a driver which writes the correction image signal to a pixel electrode of the pixel, wherein the compensation voltage is based on pixel capacitances prior to and subsequent to variation of the gradation value and a voltage subsequent to the variation of the gradation value.

Embodiments will be described hereinafter with reference to the accompanying drawings. The disclosure is a mere example, and arbitrary change of gist which can be easily conceived by a person of ordinary skill in the art naturally falls within the inventive scope. To better clarify the explanations, the drawings may pictorially show width, thickness, shape, etc., of each portion as compared with an actual aspect, but they are mere examples and do not restrict the interpretation of the invention. In the present specification and drawings, elements like or similar to those in the already described drawings may be denoted by similar reference numbers and their detailed descriptions may be arbitrarily omitted.

A liquid crystal display device and a method of driving the liquid crystal display device and a drive processing device, according to an embodiment, will be described in detail.

Figure 1:
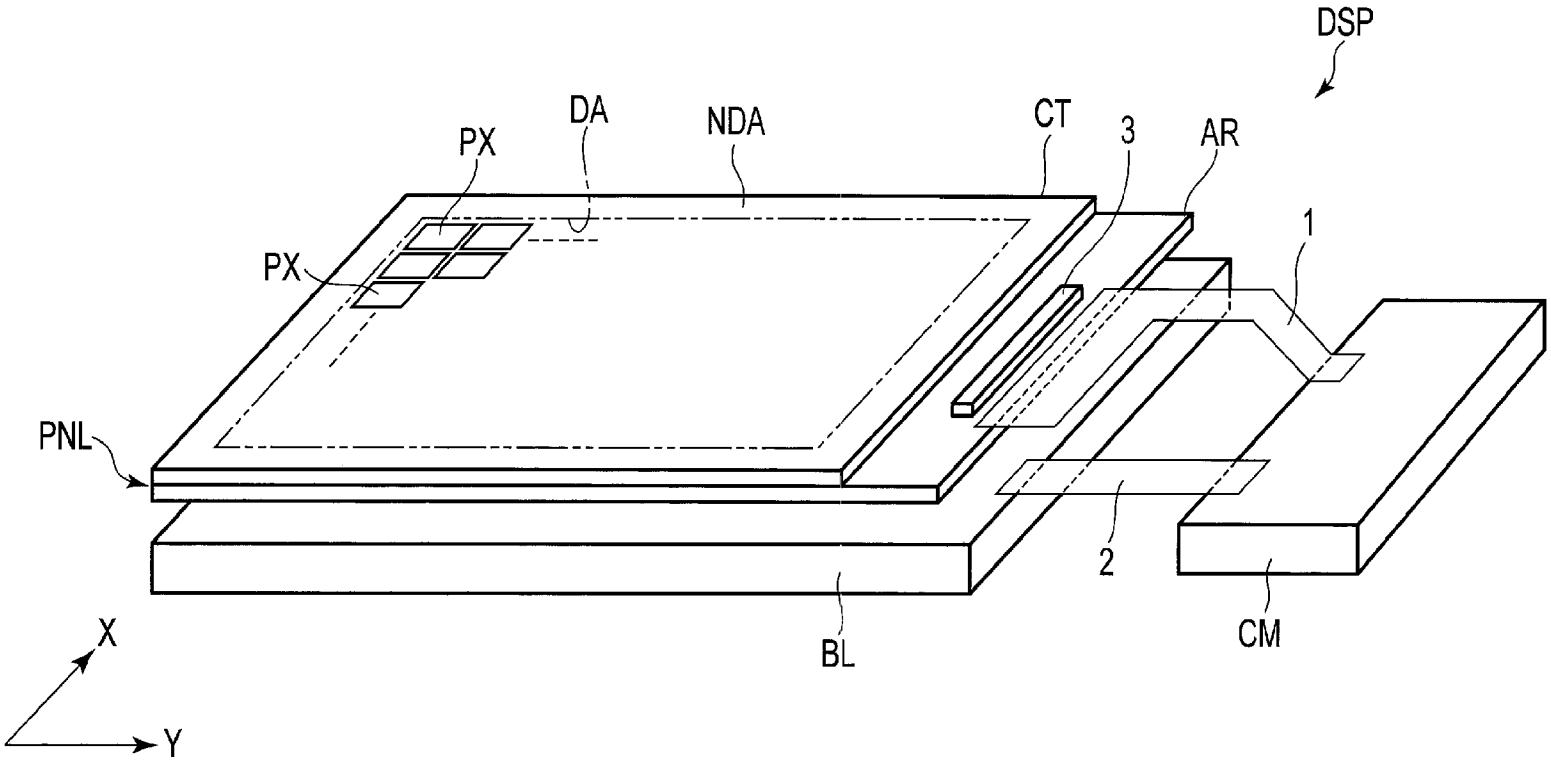
FIG. 1 is a perspective view illustrating a structure of a liquid crystal display device according to an embodiment.

FIG. 1 is a perspective view illustrating a configuration of a liquid crystal display device DSP. In the embodiment, a first direction X and a second direction Y are perpendicular to each other, but may cross each other at an angle other than 90°.

As illustrated in FIG. 1, the liquid crystal display device DSP comprises an active-matrix liquid crystal display panel PNL, a drive IC 3 which drives the liquid crystal display panel PNL, a backlight unit BL which illuminates the liquid crystal display panel PNL, a control module CM, flexible printed circuits 1 and 2, etc.

The liquid crystal display panel PNL includes an array substrate AR and a counter-substrate CT opposite to the array substrate AR. The liquid crystal display panel PNL includes a display area DA which displays an image and a non-display area NDA which is formed in the shape of a frame in such a way as to surround the display area DA. The liquid crystal display panel PNL comprises a plurality of pixels PX arranged in a matrix in a first direction X and a second direction Y in the display area DA.

The backlight unit BL is provided on a rear surface of the array substrate AR. As the backlight unit BL, various structures can be applied. However, a detailed explanation of the structure of the backlight unit BL will be omitted. The drive IC 3 is mounted on the array substrate AR. The flexible printed circuit 1 connects the liquid crystal display panel PNL and the control module CM to each other. The flexible printed circuit 2 connects the backlight unit BL and the control module CM to each other.

The liquid crystal display device DSP having the above structure corresponds to a transmissive liquid crystal display device in which pixels PX are each controlled such that they are selectively caused to transmit light incident from the backlight unit BL onto the liquid crystal display panel PNL, to thereby display an image. However, the liquid crystal display device DSP may be a reflective liquid crystal display device in which pixels PX are each controlled such that they are selectively caused to reflect external light traveling from the outside toward the liquid crystal display panel PNL, to thereby display an image, or it may be a transreflective liquid crystal display device having both transmissive and reflective functions.

Figure 2:
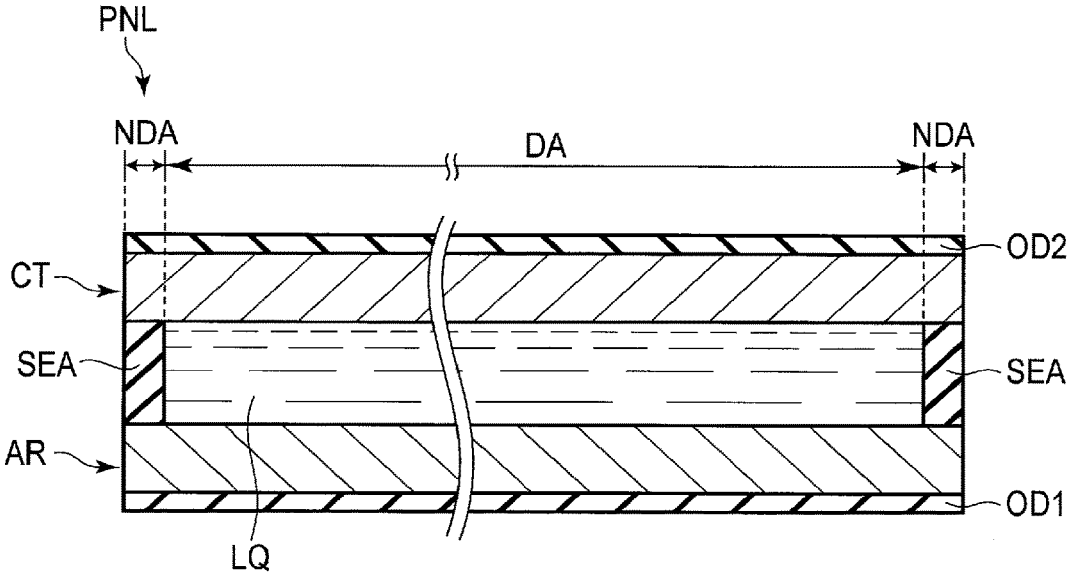
FIG. 2 is a cross sectional view of a liquid crystal display panel as shown in FIG. 1.

FIG. 2 is a cross-sectional view of the liquid crystal display panel PNL.

As illustrated in FIG. 2, the liquid crystal display panel PNL includes the array substrate AR, the counter-substrate CT, a liquid crystal layer LQ, a sealing member SEA, a first optical element OD1, a second optical element OD2, etc. The array substrate AR or the counter-substrate CT includes a color filter. For example, the color filter includes colored layers which are red (R), green (G) and blue (B).

The sealing member SEA is disposed in the non-display area NDA to attach the array substrate AR and the counter-substrate CT to each other. The liquid crystal layer LQ is held between the array substrate AR and the counter-substrate CT. The first optical element OD1 and the liquid crystal layer LQ are located on opposite sides of the array substrate AR, respectively; that is, they are located opposite to each other with respect to the array substrate AR. The second optical element OD2 and the liquid crystal layer LQ are located on opposite sides of the counter-substrate CT, respectively; that is, they are located opposite to each other with respect to the counter-substrate CT. Each of the first optical element OD1 and the second optical element OD2 includes a polarizer. It should be noted that each of the first and second optical elements OD1 and OD2 may include another optical element or elements such as a retardation film.

Figure 3:
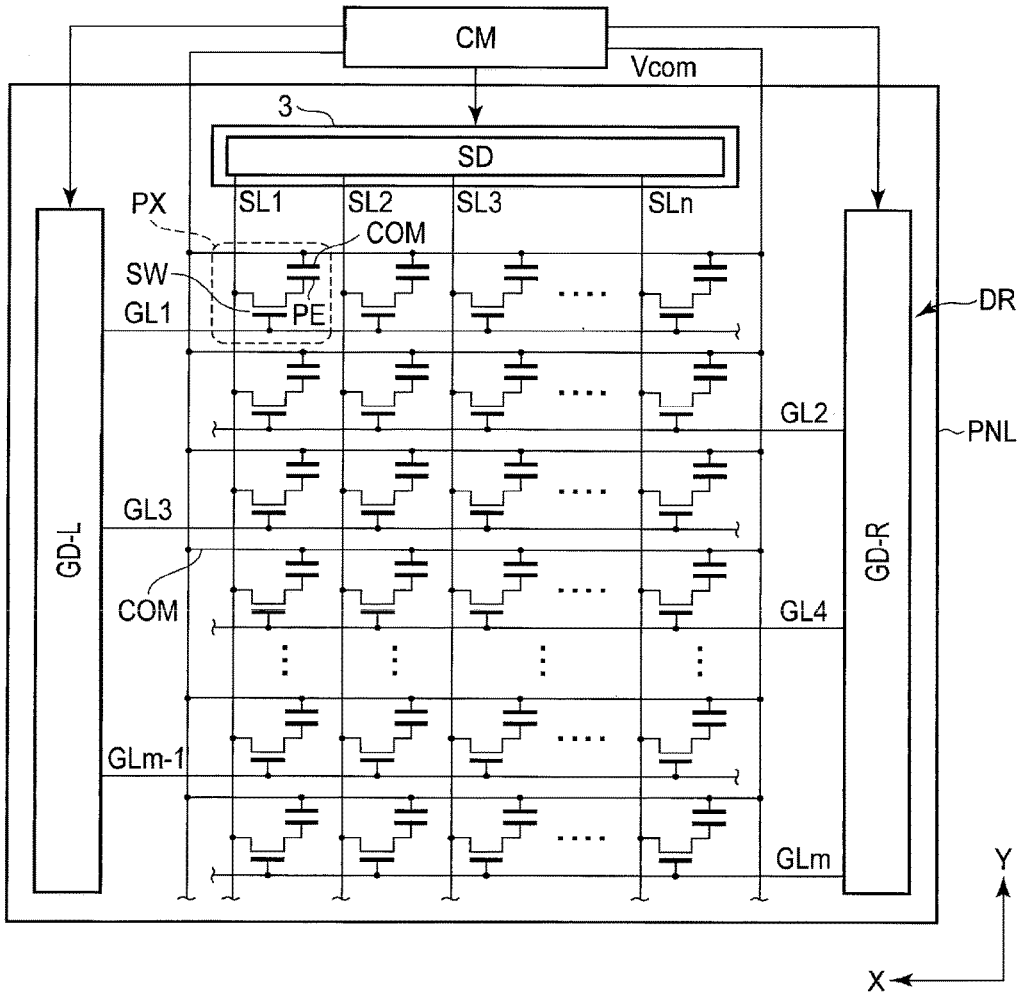
FIG. 3 is a plan view illustrating a configuration of the liquid crystal display device.

FIG. 3 is a plan view illustrating a configuration of the liquid crystal display device DSP.

As illustrated in FIG. 3, the liquid crystal display panel PNL includes scanning lines GL, signal lines SL, pixel switches SW, pixel electrodes PE, common electrode (counter-electrode) COM, scanning-line drive circuits GD, etc. Of these elements, the scanning lines GL, the signal lines SL, the pixel switches SW, the pixel electrodes PE and the scanning-line drive circuits GD are provided in the array substrate AR. The liquid crystal display panel PNL according to the embodiment has a structure adapted for a fringe field switching (FFS) mode which is a kind of in-plane switching (IPS) mode. Thus, the common electrode COM is also provided in the array substrate AR.

It should be noted that the liquid crystal display panel PNL may have a structure adapted for a display mode different from the FFS mode. For example, the liquid crystal display panel PNL may have a structure adapted for a mode primarily utilizing a longitudinal electric field substantially perpendicular to a main surface of the substrate, such as a vertical aligned (VA) mode. In a structure adapted for a display mode utilizing a longitudinal electric field, for example, the common electrode COM is provided in the counter-substrate CT, not the array substrate AR.

The scanning lines GL (GL1, GL2, . . . ) extend in the first direction X, in which a plurality of pixels PX are arranged. The signal lines SL (SL1, SL2, . . . ) extend in the second direction Y, in which a plurality of pixels PX are also arranged. The pixel switches SW are located close to intersections of the scanning lines GL and the signal lines SL.

The pixel switches SW comprise thin-film transistors (TFTs). A first electrode of each of the pixel switches SW is electrically connected to an associated scanning line GL. A second electrode of each pixel switch SW is electrically connected to an associated signal line SL. A third electrode of each pixel switch SW is electrically connected to an associated pixel electrode PE. In the embodiment, it is assumed that the first electrode functions as a gate electrode, one of the second and third electrodes functions as a source electrode, and the other functions as a drain electrode.

The drive IC 3 includes a signal-line drive circuit SD. The array substrate AR includes the scanning-line drive circuits GD (left scanning-line drive circuit GD-L and right scanning-line drive circuit GD-R). The scanning lines GL are electrically connected to output terminals of the scanning-line drive circuits GD. The signal lines SL are electrically connected to output terminals of the signal-line drive circuit SD. The scanning-line drive circuits GD and the drive IC 3 (the signal-line drive circuit SD) function as a driver DR which drives a plurality of pixels PX.

Also, the scanning-line drive circuits GD and the drive IC 3 are located in the non-display area NDA. The scanning-line drive circuits GD apply on-voltages to the scanning lines GL in turn, whereby the gate electrode of a pixel switch SW electrically connected to a selected scanning line GL is given an on-voltage. The source electrode and drain electrode of the pixel electrode SW the gate electrode of which is given the on-voltage are electrically connected to each other. The signal-line drive circuit SD supplies output signals to the signal lines SL, respectively. Through the pixel switch SW whose source and drain electrodes are electrically connected to each other, an output signal supplied to a signal line SL is supplied to an associated pixel electrode PE. Thereby, a gradation value of an associated pixel PX can vary.

The operation of the driver DR is controlled by the control module CM. Also, the control module CM applies a common voltage Vcom to the common electrode COM.

Under a control by the control module CM, the drive mode of the driver DR is switched to any one of a plurality of kinds of drive modes using different drive frequencies, and each driver DR drives pixels PX including pixel electrodes PE, etc., in the above set drive mode.

That is, the driver DR has a function of driving pixels PX with a standard drive frequency, and also of driving pixels PX with a drive frequency below the standard drive frequency in order to reduce drive power. It should be noted that a time period in which an image signal (for example, a video signal) to each of pixel electrodes PE is subjected to rewrite processing is referred to as a single frame period, and the reciprocal thereof is referred to as the drive frequency or frame frequency. It is assumed that the above is true of an intermittent driving in the embodiment.

It is assumed by way of example that a standard drive frequency of the liquid crystal display device DSP is 60 Hz (that is, an image signal to a pixel PX is subjected to rewrite processing every 1/60 s). In the case where the liquid crystal display device DSP displays moving images, it operates at 60 Hz. On the other hand, in a display operation in which importance is not attached to visibility of moving images, for example, in the case of displaying a still image, the liquid crystal display device DSP can be operated at a frequency below 60 Hz.

In the case where a low-frequency driving is selected by switching, the driver DR performs a write operation of one frame (scanning a screen from top to bottom) for 1/60 s, and then enter an idle period of, for example, 1/60, 2/60, 3/60, 4/60, 5/60, 9/60, 11/60, 14/60, 19/60, 29/60 or 59/60 s. In the idle period, the write operation of the driver DR is stopped, as a result of which the power consumption is substantially zero, except the consumption of power which is required by an operation performed regardless of a frequency. Thus, the hourly average of the total power consumption of a circuit operation of the driver DR, which includes the write operation, is reduced to, for example, 1/2 to 1/60.

That is, in the embodiment, the driver can drive each of pixel electrodes PE at a drive frequency of 1 to 30 Hz.

However, in the above low-frequency driving, the drive frequency is not limited to the range of 1 to 30 Hz; that is, it suffices that the drive frequency is set to less than 60 Hz. For example, the drive frequency in the low-frequency driving may be 0.1 Hz. If the drive frequency is 0.1 Hz, a write period of 1/60 s and an idle period of 9+59/60 s are alternately provided.

Figure 4:
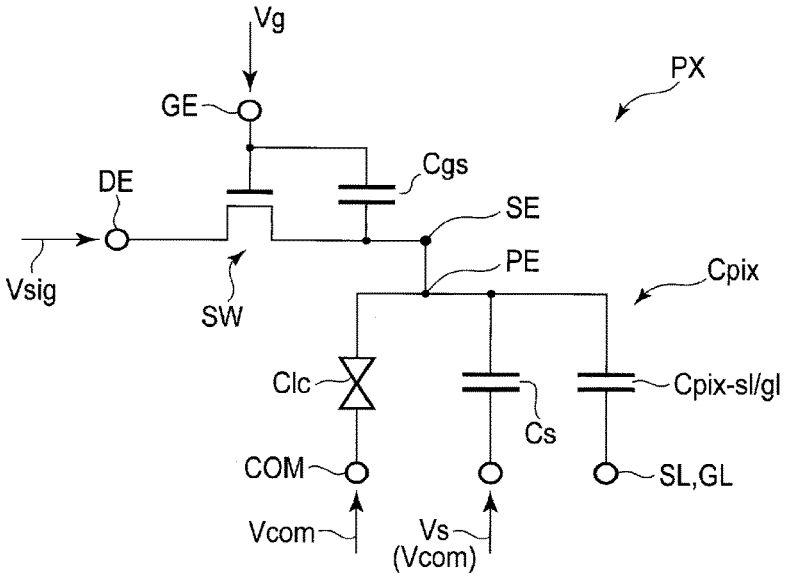
FIG. 4 is an equivalent circuit diagram illustrating a pixel as shown in FIG. 3.

FIG. 4 is an equivalent circuit diagram illustrating one of the pixels PX as illustrated in FIG. 3.

As illustrated in FIG. 4, in the example thereof, in a pixel switch SW, the above gate electrode is a gate electrode GE, the second electrode is a drain electrode DE, and the third electrode is a source electrode SE. To the drain electrode DE, an image signal Vsig is supplied through a signal line SL, etc. To the gate electrode GE, a control signal Vg is supplied through a scanning line GL, etc. To a common electrode COM, a common voltage Vcom is applied. To a pixel electrode PE, a pixel capacitor having a pixel capacitance Cpix is coupled.

As given by the equation below, the pixel capacitance Cpix is the sum of a liquid crystal capacitance Clc, an auxiliary capacitance Cs, a first coupling capacitance Cgs and a second coupling capacitance C (pix−sl/gl).

$$Cpix=Clc+Cs+Cgs+C(pix-sl/gl).$$

It should be noted that the liquid crystal capacitance Clc is a capacitance corresponding to an electric field generated in the liquid crystal layer LQ, and is also generated between the pixel electrode PE and the common electrode COM. The pixel capacitance Cpix depends on the voltage of a signal which is transmitted in the pixel electrode. The pixel capacitance Cpix may be a value which when the pixel capacitance Cpix is computed, does not depend on the auxiliary capacitance Cs, the first coupling capacitance Cgs, the second coupling capacitance C (pix−sl/gl), or the voltage of a signal which is transmitted in the pixel electrode.

The auxiliary capacitance Cs is generated between the pixel electrode PE and an electrode which is opposite to the pixel electrode PE and to which a voltage Vs is applied. As the electrode, for example, a common electrode COM can be used.

The first coupling capacitance Cgs is generated between the gate electrode GE and source electrode SE of the pixel switch SW.

The second coupling capacitance C (pix−sl/gl) is the sum of a capacitance generated between the pixel electrode PE and a signal line SL and a capacitance generated between the pixel electrode PE and a scanning line GL.

Figure 5:
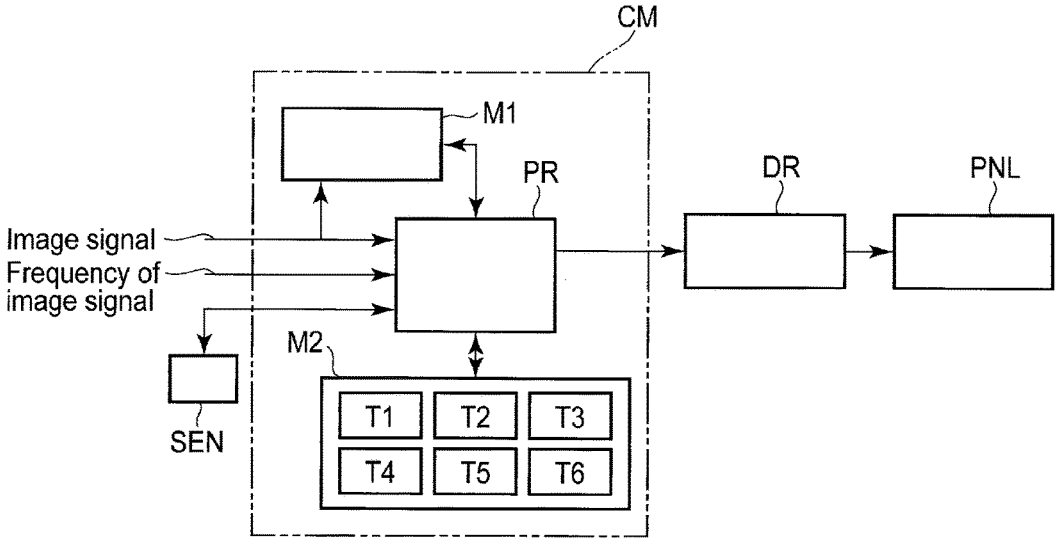
FIG. 5 is a block diagram illustrating the configuration of the liquid crystal display device.

FIG. 5 is a block diagram illustrating a configuration of the liquid crystal display device DSP.

As illustrated in FIG. 5, the liquid crystal display device DSP further comprises a temperature sensor SEN in addition to the liquid crystal display panel PNL, the driver DR and the control module CM.

The driver DR and the control module CM form a drive processing device. The control module CM comprises a processor PR, a first storage module M1 and a second storage module M2. The processor PR and the first storage module M1 are notified of the gradation value of the image signal Vsig. This notification is made from the outside of the control module CM.

Furthermore, the processor PR is notified of the frequency of the image signal Vsig. This notification is also made from the outside of the control module CM.

The temperature sensor SEN acquires temperature data, and gives it to the processor PR. It should be noted that the processor PR can periodically acquire temperature data from the temperature sensor SEN. Alternatively, the processor PR can be set to monitor the temperature sensor SEN and thus acquire temperature data at all times.

The processor PR executes processing on the basis of the data (gradation value and frequency) on the image signal Vsig, the temperature data, data stored in the first storage module M1, data stored in the second storage module M2, etc. Then, the processor PR supplies the driver DR with the image signal Vsig and a correction image signal obtained by the processing.

For example, the processor PR receives a first image signal having a first gradation value, immediately before receiving a second image signal having a second gradation value; and supplies, if the second gradation value does not vary from the first gradation value, the driver DR with the second image signal, and supplies, if the second gradation value varies from the first gradation value, the driver DR with a correction image signal based on an addition image signal obtained by adding a compensation voltage ΔVsig ($L_2$) to the second image signal. Furthermore, if the difference between the gradation values of the first and second image signals is greater than or equal to 1, the voltage of the second image signal can be corrected.

However, it may be set that if the difference between the gradation values of the first and second image signals is greater than or equal to 1, the processor PR determines whether or not to correct the voltage of the second image signal. To be more specific, in this case, it can be set as follows: the processor PR determines whether the difference between the gradation values of the first and second image signals is greater than or equal to a specific value; and if the above difference is greater than or equal to the specific value, the processor PR supplies the correction image signal to the driver DR, and if the difference is less than the specific value, the processor PR supplies the second image signal to the driver DR.

In the case where each of colors is displayed with a 256-step (256-level) gradation, the above specific value can be set to 5. It should be noted that the number of levels of gradation and the specific value are described by example. That is, the number of levels of gradation and the specific value are not limited to the above number and value, and can be variously set.

Also, the processor PR may be set to determine whether or not to compensate for the voltage of the second image signal in accordance with the drive mode of the driver DR. For example, it is assumed that in the case where the driver DR performs driving, it can switch the drive mode between a first mode in which they drive pixel electrodes PE at a first drive frequency and a second mode in which it drives the pixel electrodes PE at a second drive frequency below the first drive frequency.

In the case where the second gradation value varies from the first gradation value, and the drive mode of the driver DR is switched to the first mode, the processor PR supplies the second image signal to the driver DR without executing processing for adding the compensation voltage $\Delta Vsig(L_2)$ to the second image signal. In the case where the second gradation value varies from the first gradation value, and the drive mode of the driver DR is switched to the second mode, the processor PR executes processing for adding the compensation voltage $\Delta Vsig(L_2)$ to the second image signal (to obtain a correction image signal), and supplies the correction image signal to the processor PR.

It should be noted that where $Vsig(L_2)$ is the voltage of the second image signal, and $VA_2$ is the voltage of the addition image signal, the voltage $VA_2$ of the addition image signal is given by the following equation:

$$VA_2=\Delta Vsig(L_2)+\Delta Vsig(L_2)$$

Furthermore, where $VC_2$ is the voltage of the correction image signal, the relationship between the voltage $VA_2$ of the addition image signal and the voltage $VC_2$ of the correction image signal is given by the following equation:

$$VC_2=VA_2 \text{ or } VC_2\approx VA_2$$

This relationship will be described later.

The compensation voltage $\Delta Vsig(L_2)$ is based on: a first pixel capacitance $Cpix(L_1)$ which is the capacitance of a pixel capacitor coupled to a pixel electrode PE in a first write period in which the first image signal is written to the pixel electrode PE; a second pixel capacitance $Cpix(L_2)$ which is the capacitance of the pixel capacitor coupled to the pixel electrode PE in a second write period in which the second image signal is written to the pixel electrodes PE; and the voltage $Vsig(L_2)$ of the second image signal.

The compensation voltage $\Delta Vsig(L_2)$ is given by the following equation:

$$\Delta Vsig(L_2)=\{(Cpix(L_2)-Cpix(L_1))/Cpix(L_1)\}\times Vsig(L_2)$$

From the above equation, it can be seen that the compensation voltage $\Delta Vsig(L_2)$ varies in proportion to the voltage $Vsig(L_2)$ of the second image signal. Also, it can be seen that the compensation voltage $\Delta Vsig(L_2)$ varies in proportion to a value obtained by subtracting the first pixel capacitance $Cpix(L_1)$ from the second pixel capacitance $Cpix(L_2)$.

Furthermore, the difference between the pixel capacitance in the first write period and that in the second write period can be regarded as the difference between a liquid crystal capacitance in the first write period and that in the second write period. Where regarding the first pixel capacitance, $Clc(L_1)$ is a first liquid crystal capacitance which is the capacitance of a liquid crystal capacitor coupled to the pixel electrode PE in the first write period; and regarding the second pixel capacitance, $Clc(L_2)$ is a second liquid crystal capacitance which is the capacitance of the liquid crystal capacitor coupled to the pixel electrode PE in the second write period.

The compensation voltage $\Delta Vsig(L_2)$ can also be given by another equation below:

$$\Delta Vsig(L_2)=\{(Clc(L_2)-Clc(L_1))/Clc(L_1)\}\times Vsig(L_2)$$

Furthermore, the compensation voltage $\Delta Vsig(L_2)$ may include a correction term β. In this case, the compensation voltage $\Delta Vsig(L_2)$ is given by the following equation:

$$\Delta Vsig(L_2)=\{(Cpix(L_2)-Cpix(L_1))/Cpix(L_1)\}\times Vsig(L_9)+\beta$$

Alternatively, it is given by the following equation:

$$\Delta Vsig(L_2)=\{(Clc(L_2)-Clc(L_1))/Clc(L_1)\}\times Vsig(L_2)+\beta$$

Then, if $\{(Cpix(L_2)-Cpix(L_1))/Cpix(L_1)\}\times Vsig(L_2)$ or $\{(Clc(L_2)-Clc(L_1))/Clc(L_1)\}\times Vsig(L2)$ is replaced by α, the compensation voltage $\Delta Vsig(L_2)$ satisfies the following equation:

$$\Delta Vsig(L_2)=\alpha+\beta$$

Basically, $\alpha>\beta$.

The correction term β regarding the second signal depends on at least one of (i) the first gradation value of the first image signal, which is input immediately before inputting of the second image signal, (ii) a drive frequency at which the first image signal is written, and (iii) a temperature.

For example, the processor PR can incorporate into the compensation voltage $\Delta Vsig(L_2)$, the correction term β, which is applied as a function of the drive frequency at which the first image signal is written. The compensation voltage $\Delta Vsig(L_2)$ includes a voltage depending on the drive frequency at which the first image signal is written. Alternatively, the processor PR can derive the correction term β from the drive frequency at which the first image signal is written and the first gradation value of the first image signal. Still alternatively, the processor PR can acquire temperature data detected by the temperature sensor SEN, and derive the correction term β from the drive frequency at which the first image signal is written, the first gradation value of the first image signal and the acquired temperature data.

The driver DR supplies the liquid crystal display panel PNL with the image signal Vsig and a correction image signal having a voltage $VC_N$ (for example, a correction image signal having a voltage $VC_2$). Thereby, through a signal line SL and a pixel switch SW which is switched to enter a conductive state, the image signal Vsig, etc., are written to the pixel electrode PE at a predetermined frequency.

The outline of the voltage $VA_2$ of the addition image signal will be explained before explaining the first storage module M1 and the second storage module M2. Explanations of FIGS. 6 and 7 will be given without considering the correction term δ, and those of FIGS. 8 and 9 will be given in consideration of the correction term β.

Figure 6:
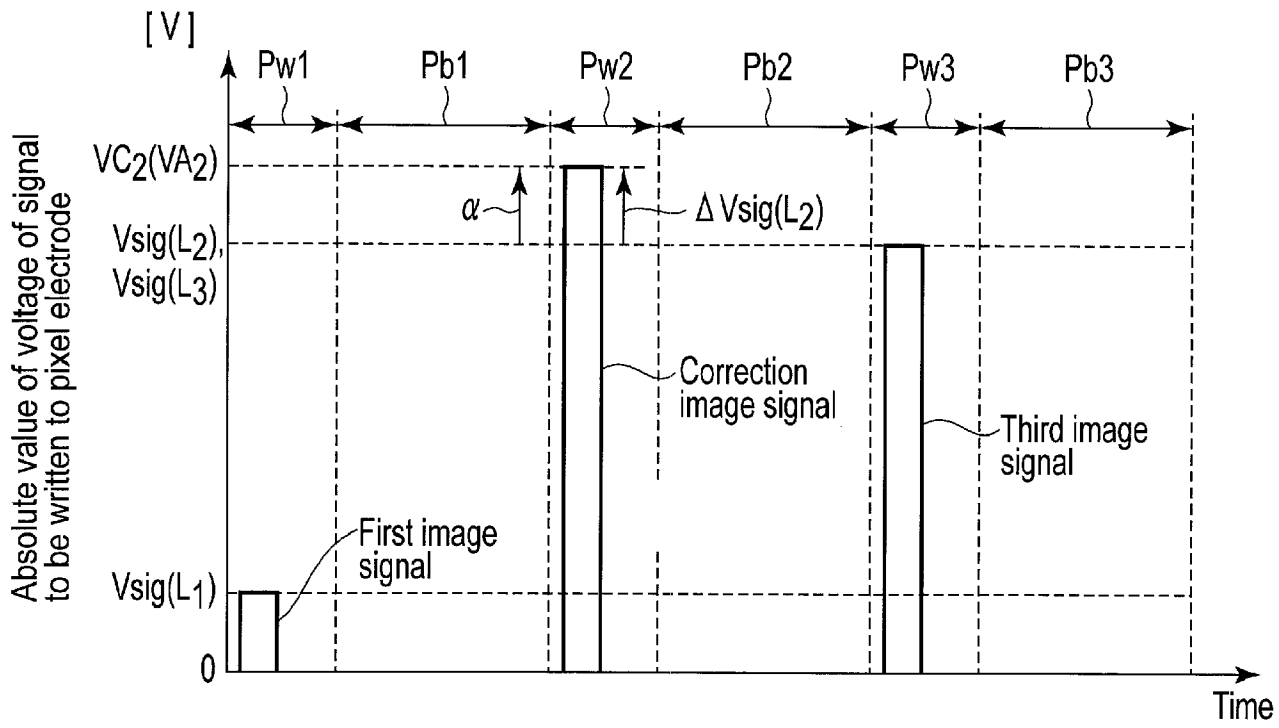
FIG. 6 is a graph which illustrates the absolute values of voltages of signals to be written to a pixel electrode in each write period, and also illustrates the case where the absolute value of the voltage of a second image signal is greater than that of the voltage of a first image signal, and a correction term is not considered.

FIG. 6 is a graph illustrating in the case where in the second mode in which pixel electrodes PE are driven at the second drive frequency, write and idle periods are alternately provided, absolute values of voltages of signals which are written to the same pixel electrode PE in respective write periods. FIG. 6 also illustrates the case where the absolute value of the voltage $Vsig(L_2)$ of the second image signal is greater than that of the voltage $Vsig(L_1)$ of the first image signal. In the following example, it is assumed that (1) each of pixel electrodes PE is driven at a drive frequency of 1 Hz, (2) a signal is written to the each pixel electrode PE at a frame rate of 60 Hz, (3) a write period is a 1-frame period, and (4) an idle period (retention period) is a 59-frame period.

As illustrated in FIG. 6, in first write period Pw1, a first image signal having the voltage $Vsig(L_1)$ is written to the pixel electrode PE. In first idle period Pb1 which is subsequent to first write period Pw1 and longer than first write period Pw1, driving of the pixel electrode PE is stopped.

In second write period Pw2 subsequent to first idle time Pb1, the correction image signal is written to the pixel electrode PE. In this example, $VC_2=VA_2$. The compensation voltage $\Delta Vsig(L_2)$ is set such that the absolute value of the voltage $VC_2$ of the correction image signal is greater than that of the voltage $Vsig(L_2)$ of the second image signal. Thereby, the potential of the pixel electrode PE in second write period Pw2 can be set to the voltage $Vsig(L_2)$.

It should be noted that in the case where in second write period Pw2, the second image signal is written to the pixel electrode PE, the absolute value of the potential of the pixel electrode PE is less than the absolute value of the voltage $Vsig(L_2)$, and an image having an undesired gradation value is displayed.

In second idle period Pb2 subsequent to second write period Pw2 and longer than second write period Pw2, driving of the pixel electrode PE is stopped. In third write period Pw3 subsequent to second idle period Pb2, a third image signal is written to the pixel electrode PE. This is because the gradation value of the third image signal is equal to the second gradation value of the second image signal. The absolute value of the voltage $Vsig(L_3)$ of the third image signal is equal to that of the voltage $Vsig(L_2)$ of the second image signal. In third write period Pw3, simply by writing the third image signal to the pixel electrode PE, the potential of the pixel electrode PE can be set to the voltage $Vsig(L_3)$.

In third idle period Pb3 subsequent to third write period Pw3 and longer than third write period Pw3, driving of the pixel electrode PE is stopped.

Figure 7:
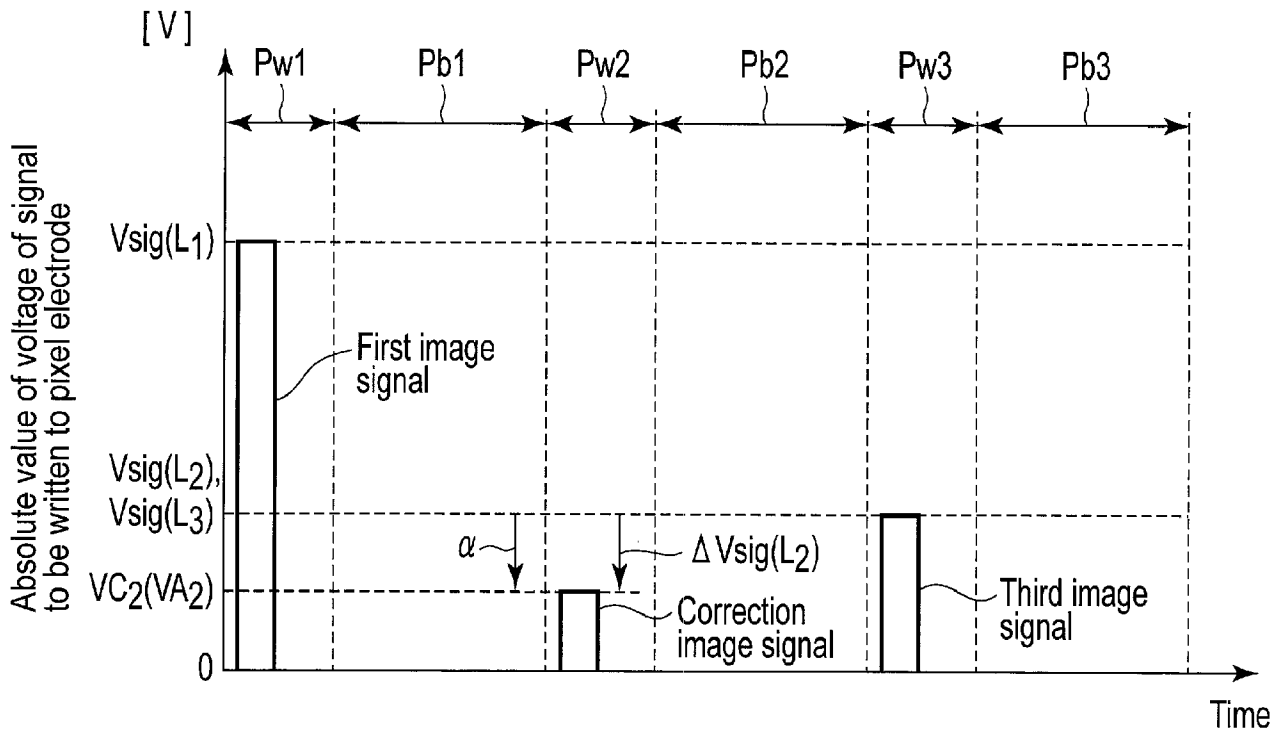
FIG. 7 is a graph which illustrates the absolute values of voltages of signals to be written to the pixel electrode in each the write period, and also illustrates the case where the absolute value of the voltage of the second image signal is less than that of the voltage of the first image signal, and the correction term is not considered.
Figure 8:
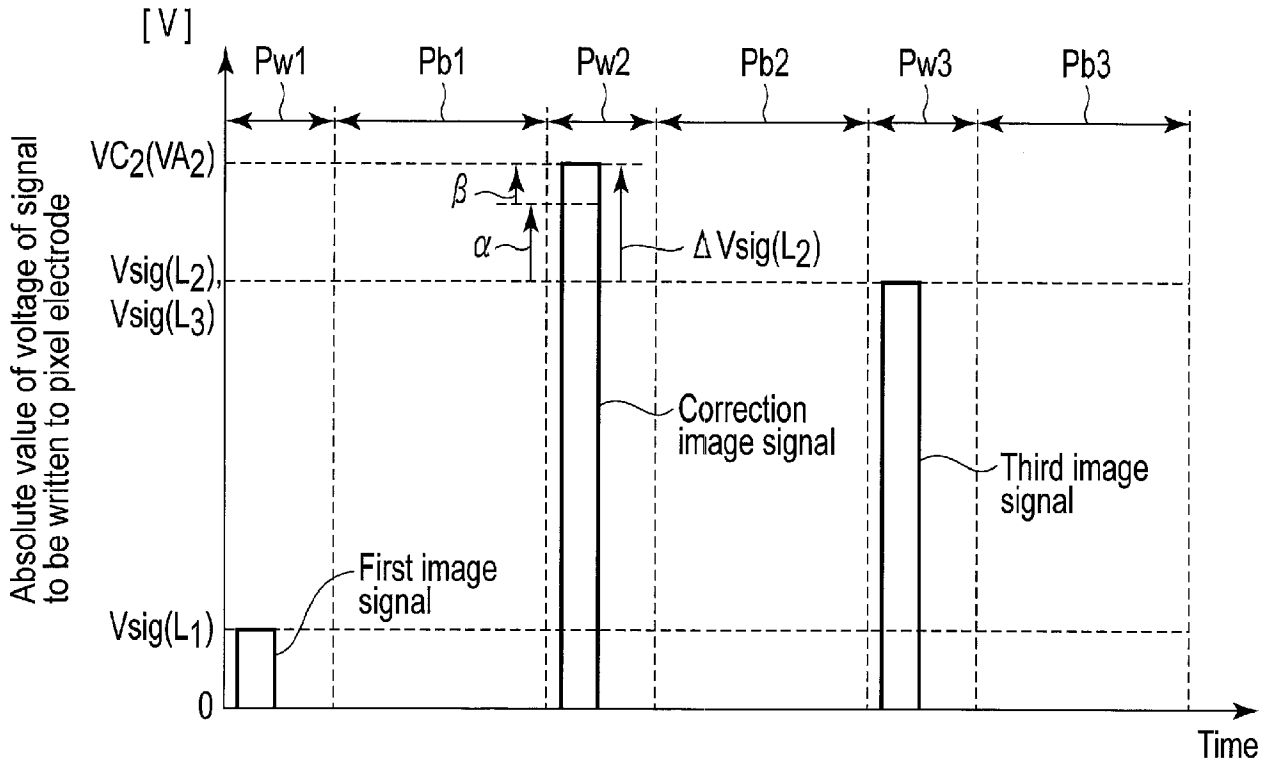
FIG. 8 is a graph which illustrates the absolute values of voltages of signals to be written to the pixel electrode in each the write period, and also illustrates the case where the absolute value of the voltage of the second image signal is greater than that of the voltage of the first image signal, and the correction term is not considered.
Figure 9:
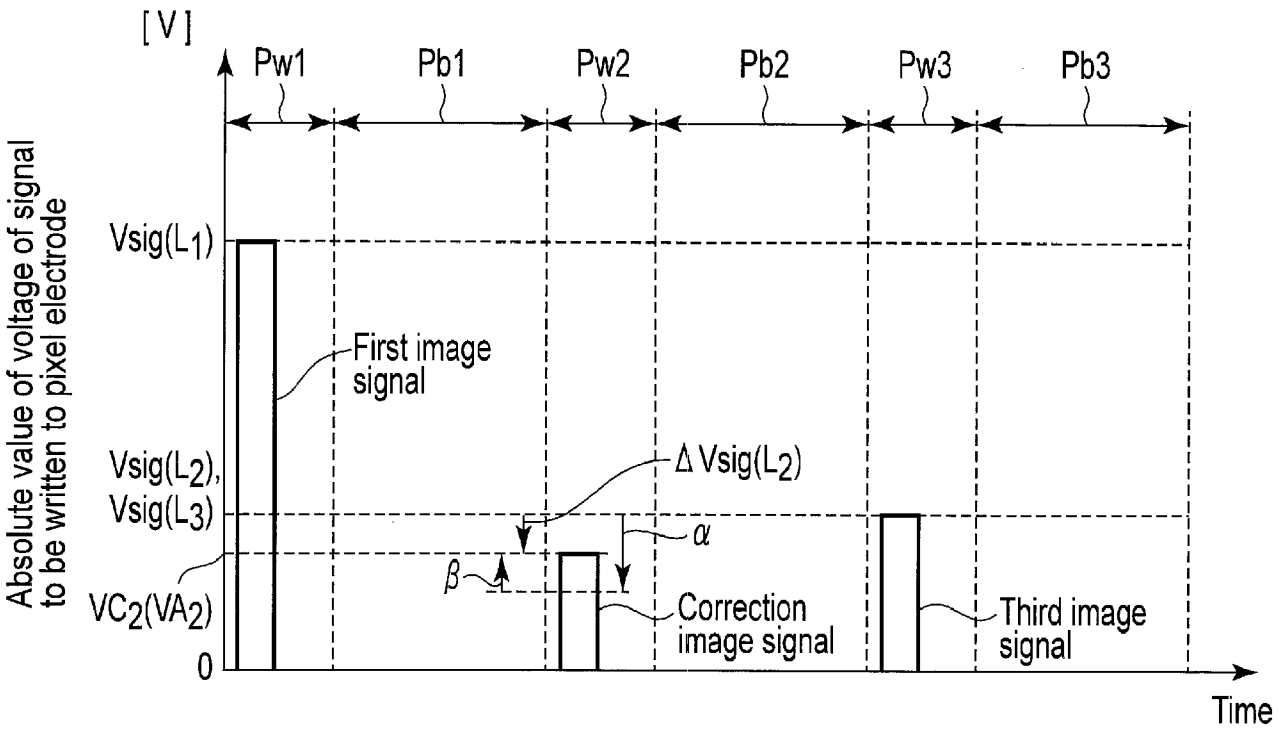
FIG. 9 is a graph which illustrates the absolute values of voltages of signals to be written to the pixel electrode in each the write period, and also illustrates the case where the absolute value of the voltage of the second image signal is less than that of the voltage of the first image signal, and the correction term is considered.

It should be noted that in not only the above explanation of FIG. 6, but the following explanations of FIGS. 7 to 9, the drive frequency of the first image signal, that of the second image signal and that of the third image signal are not limited to the same frequency (1 Hz), and may be different from each other.

FIG. 7 is a graph illustrating in the case where in the second mode in which pixel electrodes PE are driven at the second drive frequency, writing and idle periods are alternately provided, absolute values of voltages of signals which are written to the same pixel electrode PE in respective write periods. FIG. 7 also illustrates the case where the absolute value of the voltage $Vsig(L_2)$ of the second image signal is less than that of the voltage $Vsig(L_1)$ of the first image signal. Also, in the case illustrated in FIG. 7, it is assumed that the matters described in above items (1) to (4) are satisfied as in the case illustrated in FIG. 6.

As illustrated in FIG. 7, in second write period Pw2, the correction image signal is written to the pixel electrode PE. In this example also, $VC_2=VA_2$. The compensation voltage $\Delta Vsig(L_2)$ is set such that the absolute value of the voltage $VC_2$ of the correction image signal is less than that of the voltage $Vsig(L_2)$ of the second image signal. Thereby, the potential of the pixel electrode PE in second write period Pw2 can be set to the voltage $Vsig(L_2)$.

It should be noted that in the case where in second write period Pw2, the second image signal is written to the pixel electrode PE, the absolute value of the potential of the pixel electrode PE is greater than the absolute value of the voltage $Vsig(L_2)$, and an image having an undesired gradation value is displayed.

In the case illustrated in FIG. 7 also, the absolute value of the voltage $Vsig(L_3)$ of the third image signal is equal to that of the voltage $Vsig(L_2)$ of the second image signal. Thus, in third write period Pw3, simply by writing the third image signal to the pixel electrode PE, the potential of the pixel electrode PE can be set to the voltage $Vsig(L_3)$.

FIG. 8 is a graph illustrating in the case where in the second mode in which pixel electrodes PE are driven at the second drive frequency, writing and idle periods are alternately provided, absolute values of voltages of signals which are written to the same pixel electrode PE in respective write periods. FIG. 8 illustrates the case where the absolute value of the voltage $Vsig(L_2)$ of the second image signal is greater than that of the voltage $Vsig(L_1)$ of the first image signal. Also, in the case illustrated in FIG. 8, it is assumed that the matters described above in items (1) to (4) are satisfied as in the case illustrated in FIG. 6.

As illustrated in FIG. 8, in second write period Pw2, the correction image signal is written to the pixel electrode PE. In this example, $VC_2=VA_2$. The value of the correction term a is set such that the absolute value of the voltage $VC_2$ of the correction image signal is greater than that of the voltage $Vsig(L_2)$ of the second image signal. Furthermore, since the gradation value of the second image signal is greater than that of the first image signal, the correction term p increases the absolute value of the voltage $VC_2$ of the correction image signal. Thereby, the potential of the pixel electrode PE in second write period Pw2 can be set to the voltage $Vsig(L_2)$ with a high precision.

For example, as the drive frequency at the time of writing the first image signal lowers, the correction term β further increases the absolute value of the voltage $VC_2$ of the correction image signal.

In the case illustrated in FIG. 8 also, the absolute value of the voltage $Vsig(L_3)$ of the third image signal is equal to that of the voltage $Vsig(L_2)$ of the second image signal. Thus, in third write period Pw3, simply by writing the third image signal to the pixel electrode PE, the potential of the pixel electrode PE can be set to the voltage $Vsig(L_3)$.

FIG. 9 is a graph illustrating in the case where in the second mode in which pixel electrodes PE are driven at the second drive frequency, writing and idle periods are alternately provided, absolute values of voltages of signals which are written to the same pixel electrode PE in respective write periods. FIG. 9 illustrates the case where the absolute value of the voltage $Vsig(L_2)$ of the second image signal is less than that of the voltage $Vsig(L_1)$ of the first image signal. Also, in the case illustrated in FIG. 9, it is assumed that the matters described above in items (1) to (4) are satisfied as in the case illustrated in FIG. 6.

As illustrated in FIG. 9, in second write period Pw2, the correction image signal is written to the pixel electrode PE. In this example, $VC_2=VA_2$. The value of the correction term a is set such that the absolute value of the voltage $VC_2$ of the correction image signal is less than that of the voltage $Vsig(L_2)$ of the second image signal. Furthermore, since the gradation value of the second image signal is less than that of the first image signal, the correction term β decreases the absolute value of the voltage $VC_2$ of the correction image signal. Thereby, the potential of the pixel electrode PE in second write period Pw2 can be set to the voltage $Vsig(L_2)$ with high precision.

For example, as the drive frequency at the time of writing the first image signal lowers, the correction term β further decreases the absolute value of the voltage $VC_2$ of the correction image signal.

In the case illustrated in FIG. 9 also, the absolute value of the voltage $Vsig(L_3)$ of the third image signal is equal to that of the voltage $Vsig(L_2)$ of the second image signal. Thus, in third write period Pw3, simply by writing the third image signal to the pixel electrode PE, the potential of the pixel electrode PE can be set to the voltage $Vsig(L_3)$.

Next, the first storage module M1 and the second storage module M2 will be explained.

As illustrated in FIG. 5, the first storage module M1 stores data indicating the gradation value of an image signal Vsig which is input to the processor PR. For example, in the case where the first image signal is input to the processor PR and the first storage module M1, and a second image signal is then input to the processor PR and the first storage module M1, the processor PR compares the second gradation value of the second image signal with the first gradation value indicated by the data stored in the first storage module M1, and determines whether or not the second gradation value of the second image signal varies from the first gradation value of the first image signal.

It should be noted that the processor PR does not always need to determine whether or not to determine the gradation value of the input image signal Vsig varies. For example, the processor PR can determine whether or not the above gradation value varies, based on the frequency of the first image signal input immediately before inputting of the second image signal.

The second storage module M2 includes a plurality of tables. To be more specific, in the embodiment, the second storage module M2 includes first table T1, second table T2, third table T3, fourth table T4, fifth table T5 and sixth table T6. For example, these six tables are look-up tables. It should be noted that the second storage module M2 does not always need to include the six tables. Furthermore, the second storage module M2 may include a table other than the six tables. Next, the six tables and processing by the processor PR, which uses the tables, will be explained.

(First Table T1)

First table T1 includes data in which a plurality of gradation values of an image signal and a plurality of voltages thereof are associated with each other, respectively. Thus, after the processor PR produces an addition image signal, it searches first table T1 for an adaption image signal having a voltage which is the closest to the voltage $VA_2$ of the addition image signal, and supplies the driver DR with a correction image signal having a voltage $VC_2$ which is equal to the voltage of the adaption image signal. Alternatively, the processor PR determines one of the voltages indicated in first table T1, the absolute value of which is the closest to the voltage $VA_2$ of the addition image signal, as the voltage $VC_2$ of the correction image signal.

In this case, $VC_2 \approx VA_2$.

For example, in the case where the control module CM is supplied with an 8-bit image signal with respect to each of colors, and each color is displayed with a 256-step (256-level) gradation, 256 data items are stored in first table T1 in advance, and a correction image signal can be derived from the 256 data items. Then, in the case where the driver DR writes the correction image signal to a pixel electrode PE, it selects a voltage level at which the correction image signal is written to the pixel electrode PE, from among 256 voltage levels, as in the case where it writes the image signal Vsig to the pixel electrode PE.

By virtue of the above feature, for example, if first table T1 is used, an existing driver DR can be applied to the liquid crystal display device DSP; that is, it is not necessary to design or make a specific driver DR.

It should be noted that the image signal to be input to the control module CM is not limited to the 8-bit image signal; that is, it may be an image signal having bits which are less than or greater than 8 bits. For example, if a 6-bit image signal is used, the control module CM is supplied with a 6-bit image signal with respect to each of colors. In this case, it suffices that 64 data items associated with the 6-bit image signal are stored in first table T1 in advance. However, the second storage module M2 does not always need to include first table T1.

In this case, the voltage $VC_2$ of the correction image signal is equal to the voltage $VA_2$ of the addition image signal ($VC_2 = VA_2$).

The processor PR can derive the correction image signal from among a larger number of data items than 256 data items. Furthermore, in the case where the driver DR writes the correction image signal to the pixel electrode PE, it can selects a voltage level at which the correction image signal to the pixel electrode PE, from a larger number of voltage levels than 256 voltage levels.

By virtue of the above feature, for example, if first table T1 is not used, the correction image signal can be written minutely, thus an existing driver DR can be applied to the liquid crystal display device, to thereby improve the quality of a displayed image.

As described above, after the processor PR produces the addition image signal, it searches first table T1 for an adaption image signal having a voltage which is the closest to the voltage $VA_2$ of the addition image signal. In this case, there is a case where the processor PR searches for two adaption image signals from first table T1. It should be noted that it is assumed that the driver DR alternately supplies a positive signal and a negative signal to the pixel electrode PE, to thereby perform a polarity inversion drive scheme. The polarity of the second image signal is opposite to that of the first image signal. In this case, the drive frequency (frame frequency) can be referred to as a polarity inversion frequency (frame inversion frequency).

Therefore, in the case where the processor PR searches first table T1 for two adaption image signals as described above, the processor PR performs the following processing: the processor PR supplies the driver DR with a correction image signal having a voltage $VC_2$ equal to the voltage of one of the above two adaption image signals, which is smaller in absolute value than the voltage of the other.

As described above, it is preferable that the processor PR select one of the above two adaption image signals, which has a voltage smaller in absolute value than that of the voltage of the other. However, the processor PR may select one of the two adaption image signals, which has a voltage greater in absolute value than that of the voltage of the other.

Alternatively, the processor PR may determine one of the voltages indicated in first table T1, the absolute value of which is small, and which is the closest to the voltage $VA_2$ of the addition image signal, as the voltage $VC_2$ of the correction image signal.

Furthermore, the processor PR searches first table T1 for an adaption image signal having a voltage which is the closest to the voltage $VA_2$ of the addition image signal, as described above. In this case, there is a case where of the voltages in first table T1, the voltage of the adaption image signal is the greatest or the smallest.

In the case where the voltage of the adaption image signal is the greatest, and the voltage $VA_2$ of the addition image signal is greater than the voltage of the adaption image signal, the processor PR supplies the driver DR with a correction image signal having a voltage $VC_2$ which is equal to the voltage of the adaption image signal which is the greatest).

By contrast, in the case where the voltage of the adaption image signal is the smallest, and voltage $VA_2$ of the addition image signal is less than the voltage of an adaption image signal, the processor PR supplies the driver DR with a correction image signal having a voltage $VC_2$ which is equal to the voltage of the adaption image signal which is the smallest.

For example, it is assumed that the voltage $Vsig(L_2)$, which corresponds to the gradation value of the second image signal, falls within the range of −5 V to +5 V.

In the case where the voltage $VA_2$ of the addition image signal is 6 V, the processor PR derives a correction image signal having a voltage $VC_2$ of 5 V.

By contrast, in the case where the voltage $VA_2$ of the addition image signal is −6 V, the processor PR derives a correction image signal having a voltage $VC_2$ of −5 V.

(Second Table T2)

Second table T2 includes data on pixel capacitances $Cpix(L_N)$ respectively associated with voltages of an image signal. Thus, second table T2 also includes data on the above first pixel capacitance $Cpix(L_1)$ and second pixel capacitance $Cpix(L_2)$. In this case, the processor PR can compute the compensation voltage $\Delta Vsig(L_2)$, using first table T1, second table T2 and the above equation of the compensation voltage $\Delta Vsig(L_2)$. The processor PR uses not only first table T1, but second table T2, to reduce the amount of computation performed to determine the compensation voltage $\Delta sig(L_2)$.

(Third Table T3)

Third table T3 includes data on a plurality of liquid crystal capacitances $Clc(L_N)$ respectively associated with a plurality of voltages $Vsig(L_N)$ of the image signal Vsig. Thus, third table T3 also includes data items on the above first liquid crystal capacitance $Clc(L_1)$ and the second liquid crystal capacitance $Clc(L_2)$. In this case, the processor PR can compute the compensation voltage $\Delta Vsig(L_2)$ using first table T1 and third table T3. The processor PR uses not only first table T1, but third table T3, to thereby reduce the amount of computation performed to determine the compensation voltage $\Delta Vsig(L_2)$.

(Fourth Table T4)

Fourth table T4 includes data on $|Clc(L_2)-Clc(L_1)|$ associated with a combination of the first gradation value of the first image signal and the second gradation value of the second image signal. In this case, the processor PR can derive $(Clc(L_2)-Clc(L_1))$ from fourth table T4, and compute the compensation voltage $\Delta Vsig(L_2)$. The amount of data stored in fourth table T4 can be made half the amount of data in the case where fourth table T4 includes data on $(Clc(L_2)-Clc(L_1))$.

(Fifth Table T5)

Fifth table T5 includes data on the correction term β associated with a combination of the drive frequency of the first image signal and the first gradation value of the first image signal. In this case, the processor PR can derive the correction term β from fifth table T5. The processor PR can reduce, using fifth table T5, the amount of computation performed to determine the correction term β.

(Sixth Table T6)

Sixth table T6 includes data on a correction term β associated with a combination of the drive frequency of the first image signal, the first gradation value of the first image signal, and temperature data. In this case, the processor PR can derive the correction term β from sixth table T6. The processor PR can reduce using sixth table T6, the amount of computation performed to determine the correction term β.

Some examples of a method of driving the above liquid crystal display device DSP will be explained by way of example.

Figure 10:
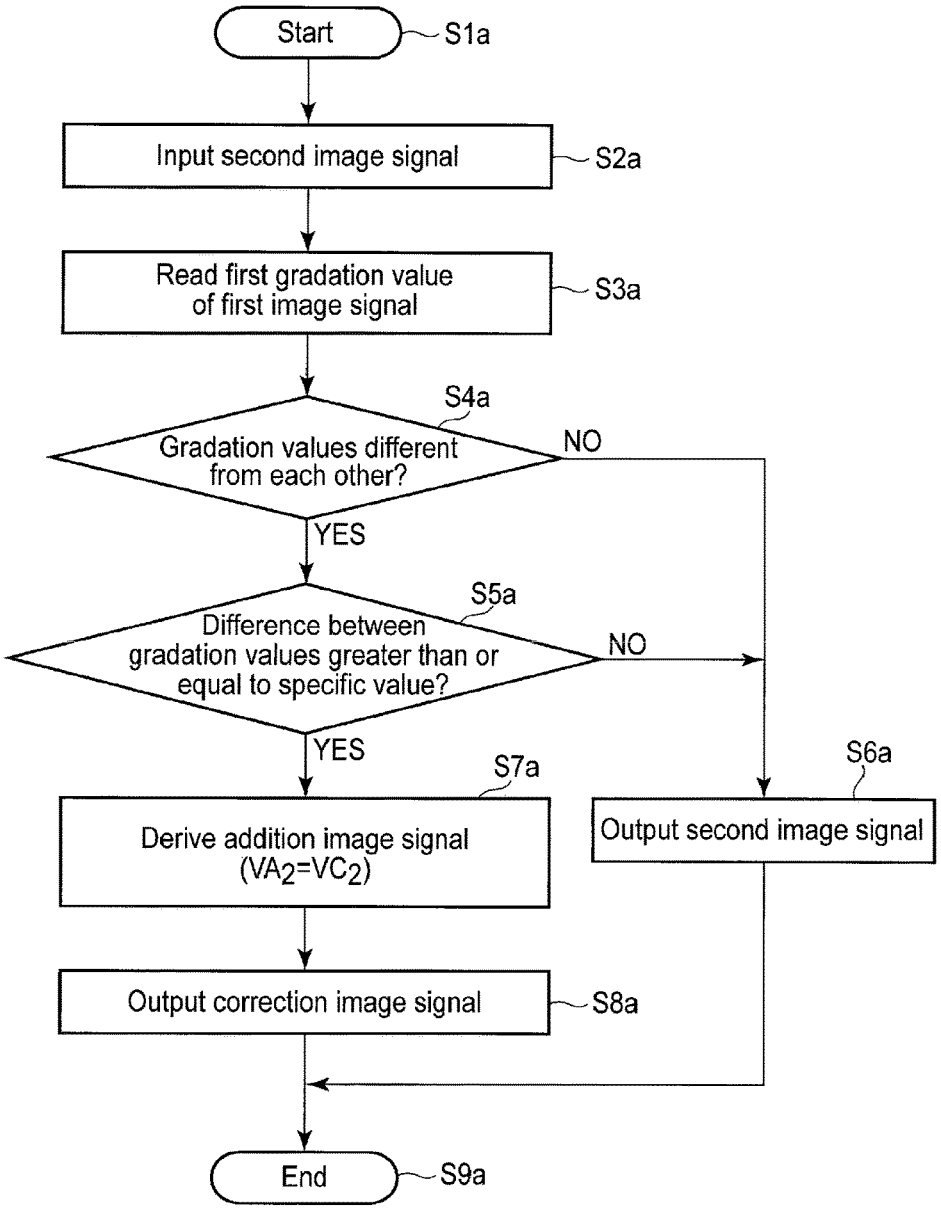
FIG. 10 is a flowchart for explaining a method of driving the above liquid crystal display device, and illustrating example 1 of processing by a processor.

FIG. 10 is a flowchart for explaining a driving method of the liquid crystal display device DSP, and also a view illustrating example 1 of the processing by the processor PR.

As illustrated in FIG. 10, first, in step S1*a*, processing by the processor PR starts, and then in step S2*a*, a second image signal is input to the processor PR. Then, in step S3*a*, the processor PR reads out the first gradation value of the first image signal from the first storage module M1.

Subsequently, in step S4*a*, the processor PR determines whether the gradation value of the first image signal and that of the second image signal are different from each other or not. When the processor PR determines that the gradation value of the first image signal and that of the second image signal are not different from each other, in step S6*a*, it outputs the second image signal to the driver DR, and the processing by the processor PR ends (step S9*a*).

By contrast, when the processor PR determines that the gradation value of the first image signal and that of the second image signal are different from each other, the step to be carried out proceeds to step S5*a*, and in step S5*a*, the processor PR determines whether the difference between the gradation values of the first and second image signals is greater than or equal to a specific value or it is less than the specific value. When the processor PR determines that the difference between the gradation values of the first and second image signals is less than the specific value, the step to be carried out proceeds to step S6*a*.

When the processor PR determines that the difference between the gradation values of the first and second image signals is greater than or equal to the specific value, the step to be carried out proceeds to step S7*a*, and in step S7*a*, the processor PR derives an addition image signal having a voltage $VA_2$, based on the above equation $VA_2 = Vsig(L_2) + \Delta LVsig(L_2)$. In this case, the relationship between the voltage $VA_2$ of the addition image signal and the voltage $VC_2$ of the correction image signal is expressed by the equation $VC_2 = VA_2$. Thus, the processor PR derives a correction image signal having a voltage $VC_2$ which is equal to the voltage $VA_2$ of the addition image signal; and in step S8*a*, the processor PR outputs the correction image signal to the driver DR, and the processing by the processor PR ends (step S9*a*).

Figure 11:
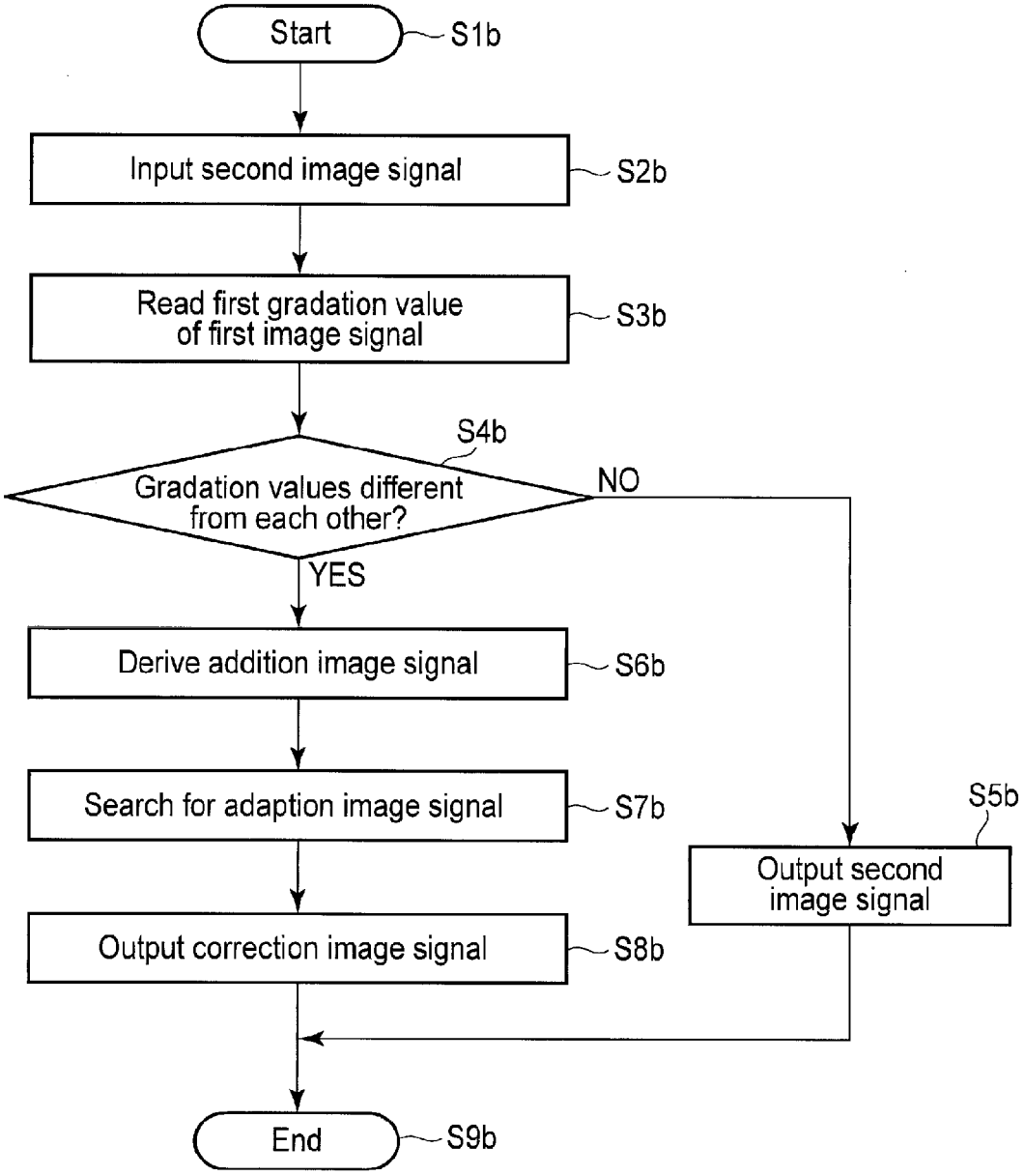
FIG. 11 is a flowchart for explaining the method of driving the above liquid crystal display device, and illustrating example 2 of the processing by the processor.

FIG. 11 is a flowchart for explaining another method of driving the liquid crystal display device DSP, and also a view illustrating example 2 of the processing by the processor PR.

As illustrated in FIG. 11, in step Slb, the processing by the processor PR starts, and in step S2*b*, a second image signal is input to the processor PR. Then, in step S3*b*, the processor PR reads out the first gradation value of the first image signal from the first storage module M1.

Subsequently, in step S4*b*, the processor PR determines whether the gradation value of the first image signal and that of the second image signal are different from each other or not. When the processor PR determines that the gradation value of the first image signal and that of the second image signal are not different from each other, in step S5*b*, it outputs the second image signal to the driver DR, and the processing by the processor PR ends (step S9*b*).

When the processor PR determines that the gradation values of the first and second image signals are different from each other, the step to be carried out proceeds to step S6*b*, and in step S6*b*, the processor PR derives an addition image signal having a voltage $VA_2$, based on the above equation $VA_2=Vsig(L_2)+\Delta Vsig(L_2)$.

Then, the step to be carried out proceeds to step S7*b*, and in step S7*b*, the processor PR searches first table T1 for an adaption image signal having a voltage which is the closest to the voltage $VA_2$ of the addition image signal. Subsequently, in step S8*b*, the processor PR outputs to the driver DR a correction image signal having a voltage $VC_2$ equal to the voltage of the adaption image signal, and the processing by the processor PR ends (step S9*b*).

According to the embodiment, in the liquid crystal display device DSP having the above structure, the method of driving the liquid crystal display device DSP, and the driving processing device for driving the liquid crystal display device DSP, the liquid crystal display device DSP comprises the liquid crystal display panel PNL, the driver DR and the processor PR.

The processor PR can supply, if the second gradation value of the second image signal varies from the first gradation value of the first image signal, the driver DR with a correction image signal based on an addition image signal in which the compensation voltage $\Delta Vsig(L_2)$ is added to the second image signal. $\Delta sig(L_2)=\alpha$. In accordance with the difference between gradation values of image signals successively input, the processor PR can perform voltage compensation on the image signals. The potential of a pixel electrode PE can be set at a predetermined value or quickly. It is therefore possible to appropriately eliminate persistence of vision which is caused by variation of the gradation value.

The drive mode of the driver DR can be switched to any of a plurality of drive modes such as a first mode in which the driver DR drives a pixel electrode PE at the first drive frequency and a second mode in which it drives the pixel electrode PE at the second drive frequency below the first drive frequency. When the drive mode of the driver DR is switched from a given drive mode to another drive mode in which a drive frequency below that of the given drive mode is applied, it is possible to reduce the number of writes by the driver DR to the pixel electrode PE (the number of times the state of a pixel switch SW is switched from the off state to the on state), and reduce the power consumption.

On the other hand, in the case where driving is switched to a low-frequency driving such as the above 1-Hz driving, and a signal is written to the pixel electrode PE at a frame rate of 60 Hz, the voltage holding period of the pixel electrode PE is longer than that in the case where the driving is switched to a 60-Hz driving. In such a manner, since the voltage holding period is increased, a voltage to be applied to the liquid crystal layer LQ decreases, and flicker easily occurs.

In light of the above point, in the embodiment, in the case where the second gradation value of the second image signal varies from the first gradation value of the first image signal, the processor PR can drive the compensation voltage $\Delta Vsig(L_2)$ in consideration of the drive frequency of the first image signal. $\Delta Vsig(L_2)=\alpha+\beta$. As described above, it is possible to appropriately eliminate the effect of persistence of vision by adding the compensation voltage $\Delta Vsig(L_2)$ determined in consideration of flicker, to the second image signal. This advantage becomes more remarkable as the drive frequency decreases.

By virtue of the above structure, it is possible to obtain a liquid crystal display device DSP, the method of driving the liquid crystal display device DSP and a drive processing device which can reduce the power consumption. Alternatively, it is possible to obtain a liquid crystal display device DSP having a high display quality, a method of driving the liquid crystal display device DSP and a drive processing device.

While certain embodiments have been described, these embodiments have been presented by way of example only, and are not intended to limit the scope of the inventions. Indeed, the novel embodiments described herein may be embodied in a variety of other forms;

furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the above embodiment is not limited to the above liquid crystal display device, the method of driving the liquid crystal display device, and the driving processing device; that is, it can be applied to various liquid crystal display devices, methods of driving the liquid crystal display devices and driving processing devices.

What is claimed is:

1. A liquid display device comprising:

a liquid crystal display panel provided with pixel which includes pixel electrode, and has gradation values that vary;

a driver which drives the pixel electrode; and a processor which supplies, if the gradation value of the pixel varies, the driver with a correction image signal based on an addition image signal in which a voltage based on the gradation value and a compensation voltage are added, wherein the processor receives a first image signal having a first gradation value, immediately before receiving a second image signal having a second gradation value; and supplies the driver with the second image signal, if the second gradation value does not vary from the first gradation value, and supplies the driver with the correction image signal based on an addition image signal in which the compensation voltage is added to the second image signal, if the second gradation value varies from the first gradation value, and the compensation voltage is based on a first pixel capacitance which is a capacitance of a pixel capacitor coupled to the pixel electrode in a first write period in which the first image signal is written to the pixel electrode, a second pixel capacitance which is the capacitance of the pixel capacitor coupled to the pixel electrode in a second write period in which the correction image signal is written to the pixel electrode, and a voltage of the second image signal.

2. The liquid crystal display device of claim 1, wherein a mode of the driver is switched between a first mode in which the driver drives the pixel electrode at a first drive frequency and a second mode in which the driver drives the pixel electrode at a second drive frequency below the first drive frequency, and in a case where the second gradation value varies from the first gradation value, and the mode of the driver is switched to the first mode, the processor supplies the driver with the second image signal without performing processing for adding the compensation voltage to the second image signal, and in a case where the second gradation value varies from the first gradation value, and the mode of the driver is switched to the second mode, the processor performs the processing for adding the compensation voltage to the second image signal, and supplies the driver with the correction image signal.

3. The liquid crystal display device of claim 2, wherein in a case where the mode of the driver is switched to the second mode, the processor determines whether a difference between gradation values of the first image signal and the second image signal is greater than or equal to a specific value, or less than the specific value;

in a case where the difference is greater than the specific value, the processor supplies the driver with the correction image signal; and in a case where the difference is less than the specific value, the processor supplies the driver with the second image signal.

4. The liquid crystal display device of claim 1, wherein in the first write period, the driver writes the first image signal to the pixel electrode;

in a first idle period subsequent to the first write period and longer than the first write period, the driver stops driving of the pixel electrode;

in a second write period subsequent to the first idle period, the driver writes the correction image signal to the pixel electrode; and in a second idle period subsequent to the second write period and longer than the second write period, the driver stops driving of the pixel electrode.

5. The liquid crystal display device of claim 1, further comprising:

a first storage module which stores data on a gradation value of an image signal which is input to the processor, wherein in a case where the processor determines whether the second gradation value varies from the first gradation value, the processor compares the second gradation value of the second image signal, which is input to the processor, with the first gradation value, which is represented by the data stored in the first storage module.

6. The liquid crystal display device of claim 1, further comprising:

a second storage module which includes a first table including data in which a plurality of gradation values of the image signal and a plurality of voltages thereof are associated with each other, respectively, wherein the processor determines one of the voltages in the first table as a voltage of the correction image signal, an absolute value of the one of the voltages being the closest to a voltage of the addition image signal.

7. The liquid crystal display device of claim 6, wherein the driver performs a polarity-inversion drive scheme, a polarity of the second image signal is opposite to that of the first image signal, an adaption image signal having the one of the voltages in the first table has a maximum voltage or a minimum voltage, when the voltage of the addition image signal is greater than that of the adaption image signal having the maximum voltage, the processor supplies the driver with the correction image signal, the voltage of which is equal to the maximum voltage, and when the voltage of the addition image signal is less than that of the adaption image signal having the minimum voltage, the processor supplies the driver with the correction image signal, the voltage of which is equal to the minimum voltage.

8. The liquid crystal display device of claim 1, further comprising:

a second storage module which includes a first table including data in which a plurality of gradation values of the image signal and a plurality of voltages thereof are associated with each other, respectively, wherein the processor determines one of the voltages in the first table as a voltage of the correction image signal, an absolute value of the one of the voltages being small and the closest to a voltage of the addition image signal.

9. The liquid crystal display device of claim 1, further comprising:

a second storage module including a first table and a second table, the first table including data in which a plurality of gradation values of the image signal and a plurality of voltages thereof are associated with each other, respectively, the second table including data on a plurality of pixel capacitances which are associated with a plurality of voltages of the image signal, respectively, $$\text{wherein } \Delta Vsig(L2)=\{(Cpix(L2)-Cpix(L1))/Cpix(L1)\}\times Vsig(L2),$$

where Cpix(L1) is the first pixel capacitance, Cpix(L2) is the second pixel capacitance, Vsig(L2) is the voltage of the second image signal, and ΔVsig(L2) is the compensation voltage, and the processor computes the compensation voltage using the first table and the second table.

10. The liquid crystal display device of claim 1, further comprising:

a second storage module including a first table and a third table, the first table including data in which a plurality of gradation values of the image signal and a plurality of voltages thereof are associated with each other, respectively, the third table including data on a plurality of liquid crystal capacitances which are associated with a plurality of voltages of the image signal, respectively, $$\text{wherein } \Delta Vsig(L2)=\{(Clc(L2)-Clc(L1))/Clc(L1)\}\times Vsig(L2),$$

where Clc(L1) is a first liquid crystal capacitance which is a capacitance of a liquid crystal capacitor coupled to the pixel electrode in the first write period in the first pixel capacitance, and Clc(L2) is a second liquid crystal capacitance which is the capacitance of the liquid crystal capacitor coupled to the pixel electrode in the second write period in the second pixel capacitance, ΔVsig (L2) is the compensation voltage, and the processor computes the compensation voltage using the first table and the third table.

11. The liquid crystal display device of claim 10, wherein the second storage module further includes a fourth table including data on |Clc(L2)−Clc(L1)| associated with a combination of the first gradation value of the first image signal and the second gradation value of the second image signal, and the processor derives (Clc(L2)−Clc(L1)) using the fourth table, and computes the compensation voltage.

12. The liquid crystal display device of claim 1, wherein the compensation voltage has a voltage depending on a drive frequency at which the first image signal is written to the pixel electrode.

13. The liquid crystal display device of claim 12, wherein $$\Delta Vsig(L2)=\{(Cpix(L2)-Cpix(L1))/Cpix(L1)\}Vsig(L2)+\beta,$$

where Cpix(L1) is the first pixel capacitance, Cpix(L2) is the second pixel capacitance, Vsig(L2) is the voltage of the second image signal, β is a correction term depending on a drive frequency at which the first image signal is written to the pixel electrode, and ΔVsig(L2) is the compensation voltage.

14. The liquid crystal display device of claim 13, wherein the correction term is a function of a drive frequency at which the first image signal is written to the pixel electrode.

15. The liquid crystal display device of claim 13, further comprising a temperature sensor, wherein the correction term is a function of temperature data detected by the temperature sensor.

16. The liquid crystal display device of claim 13, wherein according to the correction term, an absolute value of the compensation voltage is increased if the second gradation value of the second image signal is greater than the first gradation value of the first image signal, and the absolute value of the compensation value is decreased if the second gradation value of the second image signal is less than the first gradation value of the first image signal.

17. The liquid crystal display device of claim 1, wherein the voltage of the correction image signal is equal to that of the addition image signal.

18. A method of driving a liquid display device comprising:

producing, in a case where a gradation value of a pixel in a liquid crystal display panel varies, a correction image signal based on an addition image signal in which a voltage based on the gradation value and a compensation voltage are added;

writing the correction image signal to a pixel electrode of the pixel by a driver;

receiving a first image signal having a first gradation value, immediately before receiving a second image signal having a second gradation value; and supplying the second image signal to the driver, if the second gradation value does not vary from the first gradation value, and supplying the correction image signal based on an addition image signal in which the compensation voltage is added to the second image signal to the driver, if the second gradation value varies from the first gradation value, wherein the compensation voltage is based on a first pixel capacitance which is a capacitance of a pixel capacitor coupled to the pixel electrode in a first write period in which the first image signal is written to the pixel electrode, a second pixel capacitance which is the capacitance of the pixel capacitor coupled to the pixel electrode in a second write period in which the correction image signal is written to the pixel electrode, and a voltage of the second image signal.

19. A drive processing device comprising:

a processor, in a case where a gradation value of a pixel in a liquid crystal display panel varies, which produces a correction image signal based on an addition image signal in which a voltage based on the gradation value and a compensation voltage are added; and a driver which writes the correction image signal to a pixel electrode of the pixel, wherein the processor receives a first image signal having a first gradation value, immediately before receiving a second image signal having a second gradation value; and supplies the driver with the second image signal, if the second gradation value does not vary from the first gradation value, and supplies the driver with the correction image signal based on an addition image signal in which the compensation voltage is added to the second image signal, if the second gradation value varies from the first gradation value, and the compensation voltage is based on a first pixel capacitance which is a capacitance of a pixel capacitor coupled to the pixel electrode in a first write period in which the first image signal is written to the pixel electrode, a second pixel capacitance which is the capacitance of the pixel capacitor coupled to the pixel electrode in a second write period in which the correction image signal is written to the pixel electrode, and a voltage of the second image signal.

* * * * *